US011927192B2

(12) United States Patent
Walter et al.

(10) Patent No.: US 11,927,192 B2
(45) Date of Patent: Mar. 12, 2024

(54) PUMP APPARATUS, IN PARTICULAR MAGNETIC COUPLING PUMP APPARATUS

(71) Applicant: Robert Bosch GmbH, Stuttgart (DE)

(72) Inventors: Johannes Walter, Durbach (DE); Claudius Muschelknautz, Buehl (DE); Gerald Zierer, Rastatt-Wintersdorf (DE); Hannes Butscher, Sinzheim (DE); Pierre Werny, Eckwersheim (FR); Ralf Herrmann, Lauf (DE); Thomas Eckerle, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/861,298

(22) Filed: Jul. 11, 2022

(65) Prior Publication Data

US 2023/0019571 A1 Jan. 19, 2023

(30) Foreign Application Priority Data

Jul. 13, 2021 (DE) ..... 10 2021 207 404.9

(51) Int. Cl.
*F04D 13/02* (2006.01)
*F04D 13/06* (2006.01)
(Continued)

(52) U.S. Cl.
CPC ..... *F04D 13/027* (2013.01); *F04D 13/026* (2013.01); *F04D 13/0633* (2013.01);
(Continued)

(58) Field of Classification Search
CPC .. F04D 13/027; F04D 13/026; F04D 29/0413; F04D 29/20; F04D 13/0633;
(Continued)

(56) References Cited

U.S. PATENT DOCUMENTS 7,743,694 B2 * 6/2010 Becker ..... F04B 39/0044 384/620
2006/0034716 A1 * 2/2006 Marioni ..... F04D 13/06 417/423.12
(Continued)

FOREIGN PATENT DOCUMENTS

DE 4111466 A1 10/1992
DE 10140613 A1 3/2003
(Continued)

*Primary Examiner* — Dominick L Plakkoottam
(74) *Attorney, Agent, or Firm* — Michael Best & Friedrich LLP

(57) ABSTRACT

A pump apparatus has a rotor shaft, a pump impeller connected to the rotor shaft, at least one axial bearing which rotatably supports the rotor shaft at a side facing the pump impeller, a magnetic pump stator, a magnetic pump rotor which is connected to the rotor shaft, a containment can which extends between the stator and the rotor, and at least one central support element which is mounted in the region of the pump impeller. The pump apparatus has an elastomer disk which is arranged between the support element and the axial bearing. The stator and the rotor are arranged with an axial offset with respect to each other. The stator and the rotor are provided as a result of the axial offset to produce an axial force F in the direction of the elastomer disk.

9 Claims, 1 Drawing Sheet

(51) Int. Cl.
*F04D 29/041* (2006.01)
*F04D 29/046* (2006.01)
*F04D 29/20* (2006.01)

(52) U.S. Cl.
CPC ..... *F04D 13/064* (2013.01); *F04D 29/041* (2013.01); *F04D 29/0413* (2013.01); *F04D 29/046* (2013.01); *F04D 29/20* (2013.01)

(58) Field of Classification Search
CPC ..... F04D 13/064; F04D 29/041; F04D 13/06; F04D 29/046; F04D 29/086
See application file for complete search history.

(56) References Cited

U.S. PATENT DOCUMENTS

2006/0251513 A1* 11/2006 Kalavsky ..... F04D 13/064 415/206
2015/0188384 A1* 7/2015 Rumbaugh ..... H02K 5/167 310/90
2016/0138597 A1* 5/2016 LaRose ..... A61M 60/422 416/235
2016/0149449 A1* 5/2016 Ivanak ..... F04D 13/064 310/156.13
2016/0273542 A1* 9/2016 Blad ..... F04D 13/064
2016/0290340 A1* 10/2016 Maurino ..... F04D 15/0038

FOREIGN PATENT DOCUMENTS

DE 10352487 A1 2/2005
DE 102010036934 A1 5/2011
DE 102011086460 A1 * 5/2013 ..... F04D 29/0413
DE 102011086460 A1 5/2013
DE 102013211573 A1 12/2014
EP 2228891 A2 * 9/2010 ..... F04D 15/0038
JP H09317684 A 12/1997

* cited by examiner

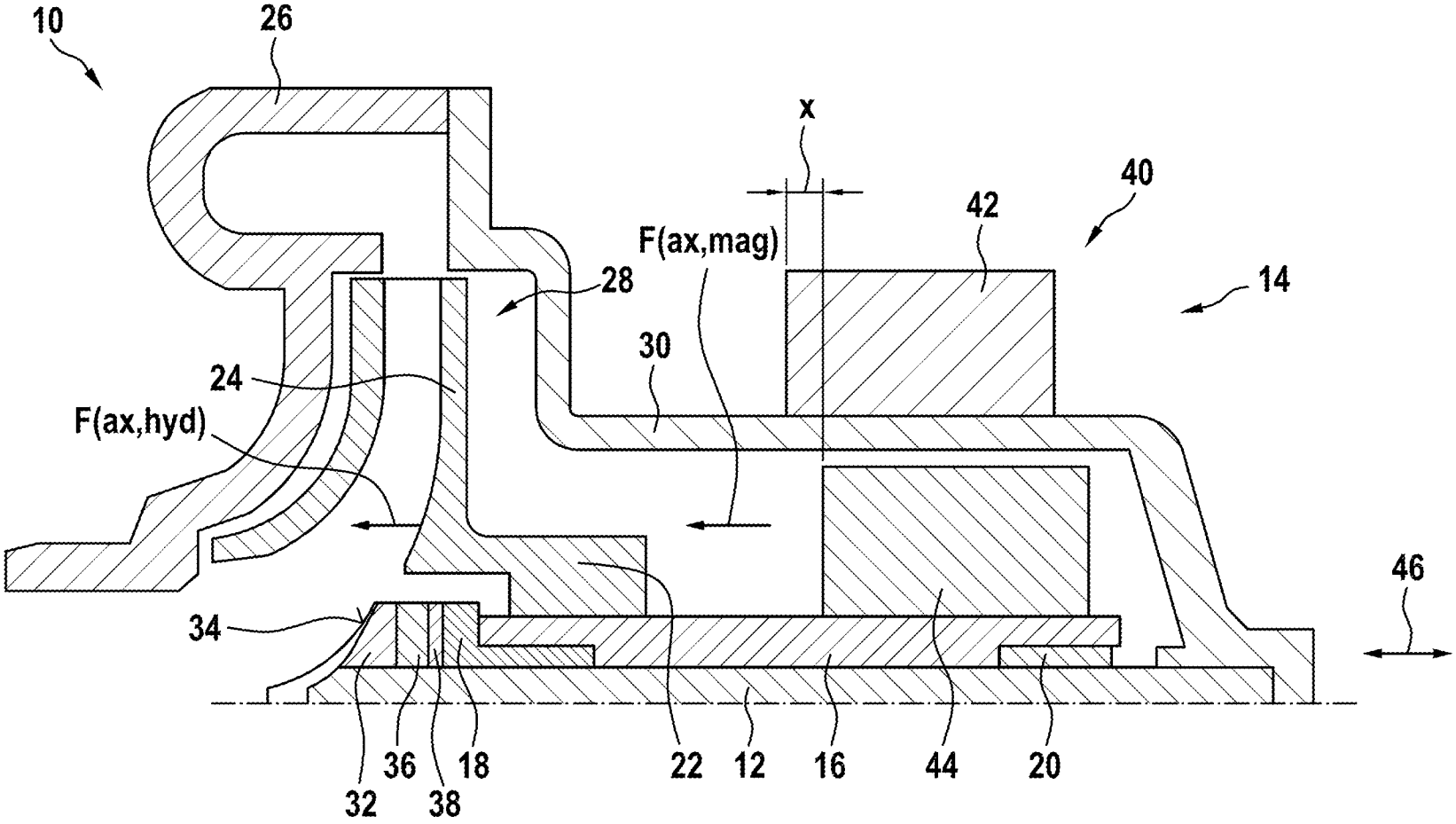
46
14
40
42
20
44
16
12
22
x
F(ax,mag)
30
28
18
38
36
32
26
24
34
F(ax,hyd)
10

PUMP APPARATUS, IN PARTICULAR MAGNETIC COUPLING PUMP APPARATUS

BACKGROUND OF THE INVENTION

A pump apparatus, in particular a magnetic coupling pump apparatus, has already been proposed.

SUMMARY OF THE INVENTION

The invention is based on a pump apparatus, in particular a magnetic coupling pump apparatus, having a rotor shaft, having a pump impeller which is securely connected to the rotor shaft, having at least one axial bearing which rotatably supports the rotor shaft at a side facing the pump impeller, having at least one magnetic pump stator, having a magnetic pump rotor which is connected to the rotor shaft in a rotationally secure manner, having a containment can which extends between the magnetic pump stator and the magnetic pump rotor and which at least partially closes a central pump space, and having at least one central support element which is mounted in the region of the pump impeller in a rotationally secure manner.

It is proposed that the pump apparatus have an elastomer disk which is arranged between the support element and the axial bearing and that the magnetic pump stator and the magnetic pump rotor be arranged with an axial offset with respect to each other, wherein the magnetic pump stator and the magnetic pump rotor are provided as a result of the axial offset X to produce an axial force F(ax, mag) in the direction of the axial bearing and the elastomer disk. A "magnetic coupling pump apparatus" is preferably intended to be understood to be a pump apparatus which is driven by means of an integrated electric motor, in particular an electromagnetic drive. The electric motor which is integrated in the magnetic coupling pump apparatus has a magnetic pump stator and a magnetic pump rotor. An "axial bearing" is preferably intended to be understood to be a plain bearing which is provided to absorb axial forces. Via the axial bearing, a rotor shaft of the pump apparatus is rotatably supported. Via the axial bearing, the rotor shaft is rotatably supported with respect to a central axis of the pump apparatus. The rotor shaft is preferably rotatably supported via the axial bearing at a first end which is arranged in the region of the pump impeller. At a second end, the rotor shaft is rotatably supported via an additional roller bearing. The additional roller bearing may be in the form of a radial bearing or an axial bearing. A "pump impeller" is preferably intended to be understood to be a rotating flow element of the pump apparatus which is provided to convey the fluid which is intended to be pumped. A "magnetic pump stator" is preferably intended to be understood to be a fixed magnetic element of the electric motor which is integrated in the pump apparatus. Preferably, the pump stator comprises for driving the electric motor electric coils through which current flows in order to operate the electric motor. In principle, however, it is also conceivable for the pump stator to comprise permanent magnets. A "magnetic pump rotor" is preferably intended to be understood to be the rotatably supported magnetic element of the electric motor which is integrated in the pump apparatus. The magnetic pump rotor is arranged in a rotationally secure manner on the rotor shaft, which is intended to be driven, of the pump apparatus. The magnetic pump rotor preferably comprises permanent magnets and/or electric coils. An "elastomer disk" is preferably intended to be understood to be a disk which is made of an elastomer material and which in particular is provided for sealing. The elastomer disk is preferably formed from an EPDM (ethylene propylene diene monomer rubber). An "axial direction" is preferably intended to be understood to be a direction which is orientated coaxially or parallel with a rotation axis of the pump apparatus, that is to say, the rotor shaft of the pump apparatus. An "axial offset" is preferably intended to be understood to be a spacing measured in an axial direction between two elements. Preferably, the axial offset X is intended to be understood to be an axially measured spacing between the magnetic center of the pump rotor and the magnetic center of the pump stator. In particular, the axial offset relates to magnetically active components of the pump stator or the pump rotor which generate a rotation of the rotor or the rotor shaft as a result of magnetic interaction.

Preferably, the axial offset X between the magnetic center of the pump stator and the magnetic center of the pump rotor is in a range from 0.5 mm to 4 mm and in a particularly advantageous embodiment in a range from 1 mm to 2 mm. As a result of the configuration of the pump apparatus according to the invention, a particularly advantageous sealing of the axial bearings can be improved, whereby in particular wear, consequently a service-life and acoustic properties, of the pump apparatus can be improved.

It is further proposed that the offset between the magnetic pump stator and the magnetic pump rotor be 1 mm. As a result of the offset, a particularly advantageous axial force can be applied to the elastomer disk.

It is further proposed that in one operating state the pump impeller be provided to generate an axial force in the direction of the elastomer disk. As a result, during operation, a force can advantageously be built up on the elastomer disk and in particular a sealing function of the elastomer disk can thereby be improved.

It is further proposed that the elastomer disk have a thickness of 1.5 mm. The elastomer disk can thereby be formed in a particularly advantageous manner.

In addition, it is proposed that a thrust washer be arranged between the elastomer disk and the axial bearing. A "thrust washer" is preferably intended to be understood to be a disk which forms an axial bearing and whose axial faces are to this end in the form of plain bearing faces. As a result of the thrust washer, a particularly advantageous axial bearing arrangement can be formed between the elastomer disk and the axial bearing.

It is further proposed that the elastomer disk be provided to be tensioned during operation as a result of the axial forces active between the axial bearing and the thrust washer. As a result of the elastomer disk, during operation production-related alignment and axial run-out errors can be compensated for in a particularly advantageous manner and it is thereby possible to achieve a particularly advantageous sealing with respect to the axial bearing.

In addition, a method for operating a pump apparatus having a magnetic pump stator, a magnetic pump rotor and having an elastomer disk is proposed, wherein, as a result of an axial offset (X), an axial force F(ax, mag) is applied to the elastomer disk and the elastomer disk is thereby tensioned.

The pump apparatus according to the invention is in this instance not intended to be limited to the above-described application and embodiment. In particular, the pump apparatus according to the invention may in order to comply with an operating method described herein have a number different from the number of individual elements, components and units mentioned herein. In addition, in the value ranges set out in this disclosure, values which are within the limits mentioned should also be considered to be disclosed and to be freely usable.

BRIEF DESCRIPTION OF THE DRAWINGS

Additional advantages will be appreciated from the following description of the drawing. The drawing illustrates one embodiment of the invention. The drawing, the description and the claims contain a number of features in combination. The person skilled in the art will also advantageously consider the features individually and combine them to form advantageous additional combinations.

In the drawings:

FIG. 1 shows a schematic sectioned view of a portion of a pump apparatus according to the invention.

DETAILED DESCRIPTION

FIG. 1 shows a cut-out of a pump apparatus 10 according to the invention, The pump apparatus 10 is in the form of a magnetic coupling pump apparatus. The pump apparatus 10 is in the form of part of a pump. In particular, the pump apparatus 10 is in the form of part of a magnetic coupling pump. The pump, in particular the magnetic coupling pump, is, for example, in the form of a coolant pump for conveying a coolant. In principle, it is conceivable for the pump to be provided for conveying another fluid.

The pump apparatus 10 has a central axle 12. The central axle 12 is part of a fixed housing 14 of the pump apparatus 10. The pump apparatus 10 comprises a rotor shaft 16. The rotor shaft 16 is rotatably supported on the central axle 12. In order to support the rotor shaft 16, the pump apparatus 10 has an axial bearing 18. The axial bearing 18 supports the rotor shaft 16 at a first end. The axial bearing 18 is in the form of a roller bearing. The pump apparatus 10 additionally has a radial bearing 20 in order to support the rotor shaft 16. The radial bearing 20 is in the form of a roller bearing. The radial bearing 20 supports the rotor shaft 16 at the second end thereof. The rotor shaft 16 is rotatably supported on the central axle 12 by means of the axial bearing 18 and the radial bearing 20.

The pump apparatus 10 comprises a pump impeller 22. The pump impeller 22 is connected to the rotor shaft 16 in a rotationally secure manner. The pump impeller 22 comprises a plurality of rotor blades 24 which are provided to convey the fluid. The pump impeller 22 is connected to a front first end of the rotor shaft 16 in a rotationally secure manner. The pump apparatus 10 comprises a housing element 26 which at least partially delimits a central pump space. The housing element 26 surrounds in an assembled state the pump impeller 22. The housing element 26 defines the central pump space 28 by a fluid which is intended to be conveyed being conveyed by the pump impeller 22. The housing element 26 is arranged in a front region of the pump apparatus 10 and defines the central pump space 28 in particular in the region of the pump impeller 22. The pump apparatus 10 has a containment can 30. The containment can 30 forms a portion of the housing 14. The containment can 30 delimits a portion of the central pump space 28. The containment can 30 extends from the housing element 26 up to a rear end of the axle 12. The containment can 30 is connected to the axle 12 and the housing element 26 in a rotationally secure manner.

The pump apparatus 10 has a central support element 32. The central support element 32 is arranged in the region of the pump impeller 22. The central support element 32 is provided to support the axial bearing 18. The support element 32 is mounted so as to be secured to the housing. The support element 32 is connected to the axle 12 in a rotationally secure manner. The support element 32 is connected to the housing element 26 in a rotationally secure manner. The support element 32 is arranged at a front first end of the axle 12. The support element 32 covers a front end of the axle 12. The support element 32 is arranged in the central pump space 28. The support element 32 is arranged in the region of the central pump space defined by the housing element 26. The support element 32 is in the form of a tripod. The support element 32 is constructed in an advantageous manner in terms of flow technology. The support element 32 is preferably provided to positively influence a flow of a fluid to the pump impeller 22. The support element 32 has a plurality of flow guiding blades 34. The support element 32 is provided by means of the flow guiding blades 34 thereof to guide a fluid which is intended to be conveyed, in particular to supply it to the pump impeller 22. As a result of the flow guiding blades 34 of the support element 32, the fluid which is intended to be conveyed can be conveyed in a particularly advantageous manner.

During operation of the pump apparatus 10, as a result of the fluid flowing in the central pump space 28, an axial force F(ax, hyd) is produced via the pump impeller 22 in the direction of the support element 32. The axial force F(ax, hyd) is in particular produced by the rotor blades 24 of the pump impeller 22 and the flowing fluid. As a result of the rotation of the pump impeller 22, the hydraulic axial force F(ax, hyd) is produced and is in this instance dependent on a speed of the pump impeller 22.

The pump apparatus 10 comprises an elastomer disk 36. The elastomer disk 26 is arranged between the support element 32 and the axial bearing 18. The elastomer disk 36 is provided to seal the axial bearing 18. The elastomer disk 36 is provided to compensate for production-related alignment and axial run-out errors. The elastomer disk 36 is preferably formed from an EPDM (ethylene propylene diene monomer rubber). In principle, it is also conceivable for the elastomer disk 36 to be formed from another elastomer. The elastomer disk 36 preferably has a thickness of 1.5 mm. In principle, thicknesses of from 1 mm to 3 mm are also conceivable. The elastomer disk 36 is arranged on the axle 12 between the support element 32 and the axial bearing 18. The elastomer disk 36 has an outer radius which substantially corresponds to an outer radius of the axial bearing 18. The pump apparatus 10 has a thrust washer 38. The thrust washer 38 is arranged between the axial bearing 18 and the elastomer disk 36. The thrust washer 38 preferably forms an axial support between the axial bearing 18 and the elastomer disk 36. The thrust washer 38 forms a plain bearing. The elastomer disk 36 is arranged between the thrust washer 38 and the support element 32. The elastomer disk 36 is provided for a tolerance compensation between the support element 32 and the thrust washer 38. The elastomer disk 36 is provided for tolerance compensation between the thrust washer 38 and the axial bearing 18.

The pump apparatus 10 comprises an integrated electric motor 40. The pump apparatus 10 which is in the form of a magnetic coupling pump apparatus is driven by means of the integrated electric motor 40. The pump apparatus 10 comprises for forming the electric motor 40 a magnetic pump stator 42 and a magnetic pump rotor 44. The magnetic pump stator 42 and the magnetic pump rotor 44 form a portion of the electric motor 40. The magnetic pump stator 42 is arranged so as to be secured to the housing. The magnetic pump stator 42 is connected to the housing 14 of the pump apparatus 10 in a rotationally secure manner. The magnetic pump stator 42 is arranged outside the central pump space 28 defined by the containment can 30. The magnetic pump stator 42 is arranged on an outer side of the containment can 30. The magnetic pump stator 42 may in this instance be mounted securely on the containment can 30. In principle, it is also conceivable for the magnetic pump stator 42 to be connected to other housing portions of the housing 14 of the pump apparatus 10 so as to be secured to the housing. The magnetic pump stator 42 preferably has a plurality of electric coils which are supplied with electric power in order to operate the electric motor 40. The magnetic pump rotor 44 is arranged so as to be able to be rotated with respect to the housing 14. The magnetic pump rotor 44 is connected to the rotatably supported rotor shaft 16 in a rotationally secure manner. The magnetic pump rotor 44 is arranged in the central pump space 28 defined by the containment can 30. The containment can 30 extends between the magnetic pump stator 42 and the magnetic pump rotor 44. The pump rotor 44 is arranged at a side of the rotor shaft 16 facing away from the pump impeller 22.

The magnetic pump stator 42 and the magnetic pump rotor 44 are arranged with an axial offset X with respect to each other. The magnetic pump stator 42 and the magnetic pump rotor 44 have the offset X in an axial direction 46. The magnetic pump stator 42 is displaced by the offset X with respect to the magnetic pump rotor 44 in the axial direction 46. In particular, magnetically acting components of the magnetic pump stator 42 and the magnetic pump rotor 44 are offset with respect to each other in an axial direction 46 by the axial offset X. The axial offset X relates in particular to a magnetic center of the pump stator 42 and the magnetic center of the pump rotor 44. The magnetic pump stator 42 and the magnetic pump rotor 44 are mounted with the axial offset X with respect to each other in the pump apparatus 10. The magnetic center of the pump stator 42 and the magnetic center of the pump rotor 44 have in a mounted state the axial offset X with respect to each other. As a result of the axial offset X between the magnetic center of the pump stator 42 and the magnetic center of the pump rotor 44, as a result of magnetic traction an axially active axial force F(ax, mag) is permanently produced. As a result of the axial offset X between the magnetic pump stator 42 and the magnetic pump rotor 44, the axial force F(ax, mag) is also applied to the rotor outside operation of the electric motor 40. As a result of the axial offset X between the magnetic pump stator 42 and the magnetic pump rotor 44, the axial force F(ax, mag) is produced in the direction of the axial bearing 18 and the elastomer disk 36. As a result of the axial offset X, by means of the interaction of the magnetic components of the pump rotor 44 with the corresponding magnetic components of the pump rotor 44, the axial force F(ax, mag) which is directed in the axial direction 46 is produced. This axial force F(ax, mag) which is produced is particularly independent of a speed of the electric motor 40 or the pump impeller 22. The axial offset X between the magnetic pump stator 42 and the magnetic pump rotor 44 is 1 mm.

The produced axial force F(ax, mag) which acts on the magnetic pump rotor 44 in the direction of the axial bearing 18 and the elastomer disk 36 is transmitted via the rotor shaft 16 to the elastomer disk 36. The axial force F(ax, mag) is transmitted via the rotor shaft 16, the axial bearing 18 and the thrust washer 38 to the elastomer disk 36. As a result of the axial force F(ax, mag) produced, the elastomer disk 36 is tensioned between the thrust washer 38 and the support element 32. As a result of the axial force F(ax, mag) acting on the elastomer disk 36, it is ensured that the axial bearing 18 via the thrust washer 38 and the elastomer disk 36 always abuts a rear side of the support element 32. As a result of the deformation of the elastomer disk 36 by the axial force F(ax, mag), a tolerance compensation is achieved between the support element 32 and the thrust washer 38. The axial forces F(ax, hyd), F(ax, mag) introduced into the elastomer disk 36 for tensioning are supported on the support element 32. The axial forces F(ax, hyd), F(ax, mag) introduced are discharged via the support element 32 into the axle 12.

The elastomer disk 36 is provided to be tensioned during operation as a result of the axial forces F(ax, hyd), F(ax, mag) acting between the support element 32 and the thrust washer 38. As a result of the tensioning via the axial forces F(ax, hyd), F(ax, mag), the resiliently deforming elastomer disk 36 can, as a result of resilient deformation, carry out the tolerance compensation and enable a permanent abutment between the axial bearing 18, the thrust washer 38, the elastomer disk 36 and the support element 32. As a result of the magnetic axial force F(ax, mag) which is produced by the offset X, a permanent axial pretensioning force is produced on the elastomer disk 36. The pretensioning force which acts on the elastomer disk 36 is additionally increased during operation by the hydraulic axial force F(ax, hyd) which is dependent on the speed. As a result of the interaction of the axial forces F(ax, hyd), F(ax, mag), a particularly advantageous tensioning of the elastomer disk 36 can be achieved during operation and thereby a particularly advantageous tolerance compensation and consequently a particularly advantageous sealing via the axial bearing 18 can be achieved.

The invention claimed is:

1. A magnetic coupling pump apparatus, having a rotor shaft (16), having a pump impeller (22) which is securely connected to the rotor shaft (16), having at least one axial bearing (18) which rotatably supports the rotor shaft (16) at a side facing the pump impeller (22), having a magnetic pump stator (42), having a magnetic pump rotor (44) which is connected to the rotor shaft (16) in a rotationally secure manner, having a containment can (30) which extends between the magnetic pump stator (42) and the magnetic pump rotor (44) and which at least partially closes a central pump space (28), and having at least one central support element (32) which is mounted in a region of the pump impeller (22) in a rotationally secure manner, characterized by an elastomer disk (36) which is arranged between the support element (32) and the axial bearing (18) and characterized in that the magnetic pump stator (42) and the magnetic pump rotor (44) are arranged with an axial offset (X) with respect to each other, whereby, as a result of the axial offset (X), the magnetic pump stator (42) and the magnetic pump rotor (44) produce an axial force F(ax, mag) in a direction of the elastomer disk (36) and a thrust washer (38) is arranged between the elastomer disk (36) and the axial bearing (18).

2. The pump apparatus according to claim 1, characterized in that the offset (X) between the magnetic pump stator (42) and the magnetic pump rotor (44) is 1 mm.

3. The pump apparatus according to claim 1, characterized in that in one operating state the pump impeller (22) is configured to generate an axial force F(ax, hyd) in the direction of the elastomer disk (36).

4. The pump apparatus according to claim 1, characterized in that the elastomer disk (36) has a thickness of 1.5 mm.

5. The pump apparatus according to claim 3, characterized in that the elastomer disk (36) is configured to be tensioned during operation as a result of the axial forces F(ax, mag), F(ax, hyd) active between the support element (32) and the thrust washer (38).

6. A method for operating the pump apparatus (10) according to claim 1, having the magnetic pump stator (42), the magnetic pump rotor (44) and having the elastomer disk (36), characterized in that, as a result of the axial offset (X), the axial force F(ax, mag) is applied to the elastomer disk (36) and the elastomer disk (36) is thereby tensioned.

7. The pump apparatus according to claim 1, wherein the axial force F(ax, mag) is exerted on the rotor shaft (16) in a direction toward the elastomer disk (36), and wherein the axial force F(ax, mag) is exerted on the elastomer disk (36) by the rotor shaft (16) via the axial bearing (18).

8. The pump apparatus according to claim 3, wherein the axial force F(ax, hyd) is exerted on the rotor shaft (16) by the pump impeller (22), and wherein the axial force F(ax, hyd) is exerted on the elastomer disk (36) by the rotor shaft (16) via the axial bearing (18) and the thrust washer (38).

9. The pump apparatus according to claim 1, wherein the axial force F(ax, mag) is exerted on the rotor shaft (16) in a direction toward the elastomer disk (36), and wherein the axial force F(ax, mag) is exerted on the elastomer disk (36) by the rotor shaft (16) via the axial bearing (18) and the thrust washer (38).

* * * * *